US006375531B1

(12) United States Patent
Melius

(10) Patent No.: US 6,375,531 B1
(45) Date of Patent: Apr. 23, 2002

(54) DOLPHIN-TAIL STYLE MULTI-PURPOSE SWIM FIN AND ASSEMBLY

(76) Inventor: John David Melius, 2725 Vista Ct., Waldorf, MD (US) 20603-6097

( * ) Notice: Subject to any disclaimer, the term of this patent is extended or adjusted under 35 U.S.C. 154(b) by 0 days.

(21) Appl. No.: 09/650,632

(22) Filed: Aug. 28, 2000

Related U.S. Application Data

(60) Provisional application No. 60/151,056, filed on Aug. 27, 1999.

(51) Int. Cl.[7] ..... A63B 31/10
(52) U.S. Cl. ..... 441/64; 441/56
(58) Field of Search ..... 441/56, 61–64; 440/14, 15

(56) References Cited

U.S. PATENT DOCUMENTS

| | | | | | |
|---|---|---|---|---|---|
| 4,737,127 | A | * | 4/1988 | Lamont | 441/64 |
| 4,934,971 | A | | 6/1990 | Picken | 441/64 |
| 4,944,703 | A | * | 7/1990 | Mosier | 441/62 |
| 5,114,371 | A | * | 5/1992 | Alonzo | 441/56 |
| 5,906,525 | A | | 5/1999 | Melius et al. | 441/64 |

* cited by examiner

*Primary Examiner*—Sherman Basinger
(74) *Attorney, Agent, or Firm*—Rodger H. Flagg

(57) ABSTRACT

A dolphin-tail style multi-purpose swim fin that connects to a flat swim fin securable to a user's foot is used to generate propulsion in the form of displaced water. When the connected dolphin-tail style swim fin flows through a path of displaced water from the flat swim fin at a proper angle of attack, it produces a lifting force that assists in swimming. The dolphin-tail style swim fin is shaped to enhance the propulsion from the flat swim fin. A swim fin assembly can be integrated with both flat and dolphin-tail style fins as one unit. The dolphin-tail style swim fin is shaped to generate lift as water flows across it and can be used directly by the hand (without a flat fin) or used with a handle that can be attached in lieu of the flat fin. When using the dolphin-tail style swim fin by hand, the swimmer uses his arms and hands to move the dolphin-tail style swim fins through the water at a proper angle of attack to produce a lifting force that increases speed, reduces overall energy requirements, helps with control, and offers the swimmer some protection from the dangers found in open water.

16 Claims, 2 Drawing Sheets

Figure 1
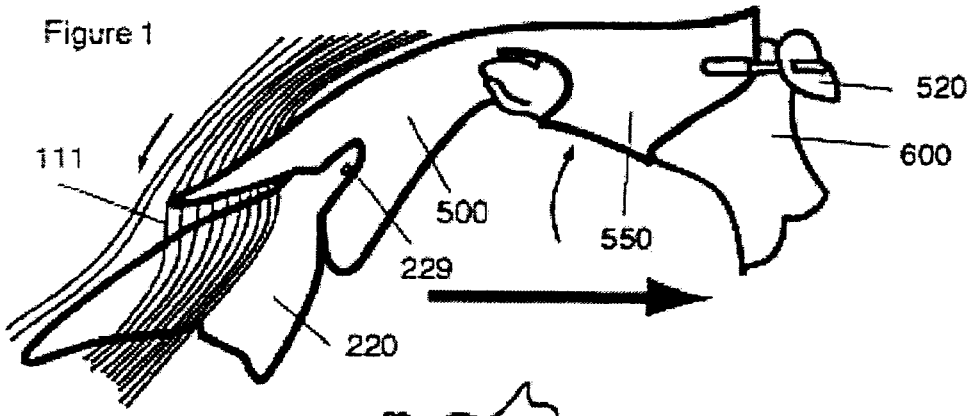
Figure 2
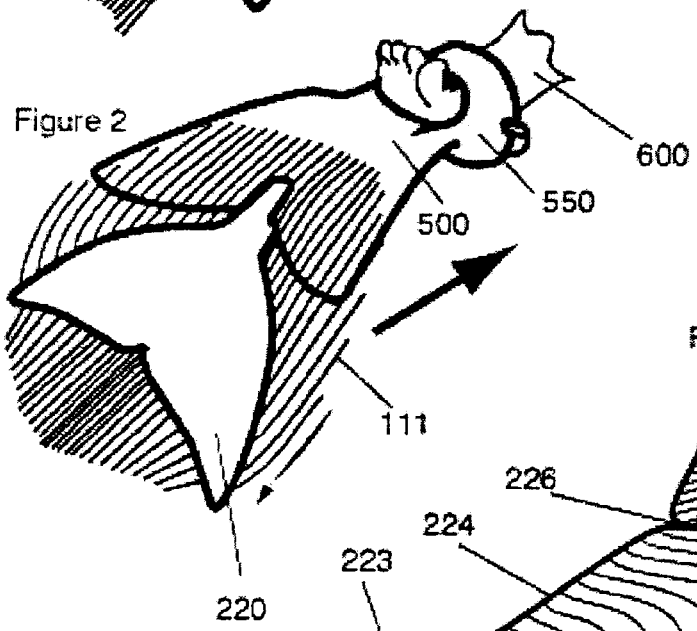
Figure 4
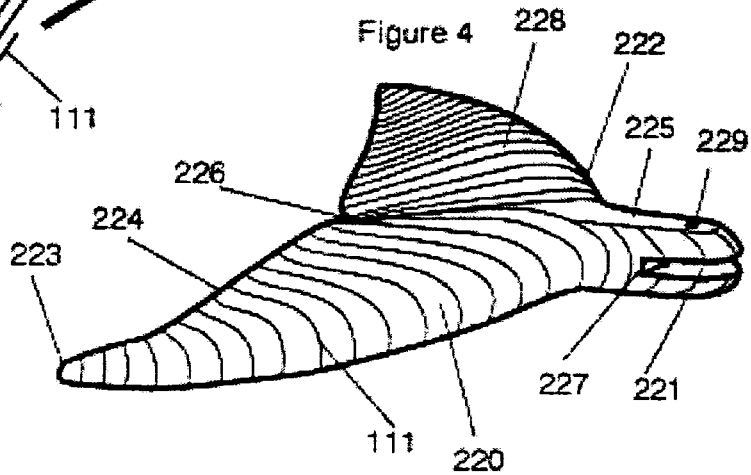
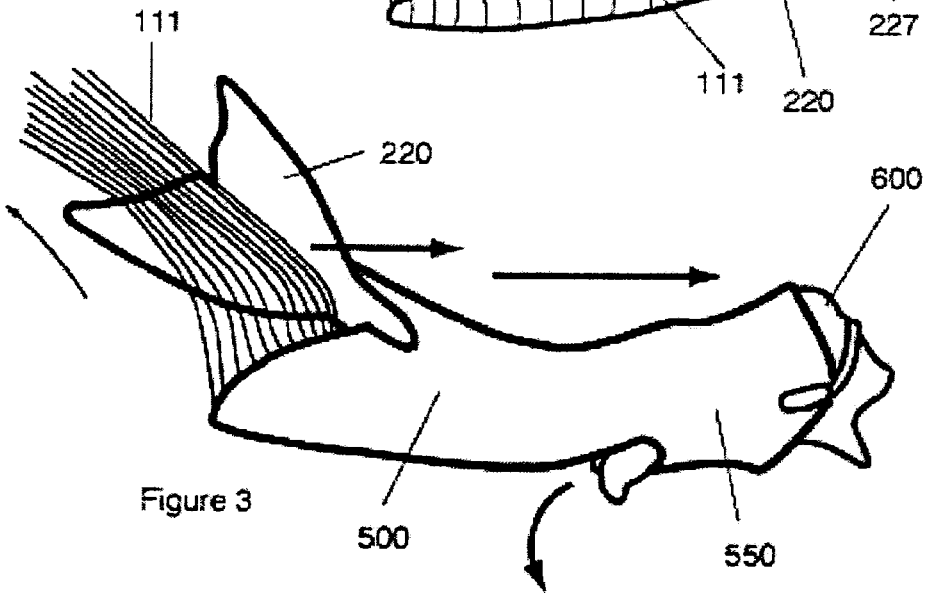
Figure 3

224
226
228
223
223
111
229
220
221

220
220
100
100
220
220
220
100

100
300
220
220

DOLPHIN-TAIL STYLE MULTI-PURPOSE SWIM FIN AND ASSEMBLY

This application claims the benefit of U.S. Provisional Patent Application Ser. No. 60/151,056, filed Aug. 27, 1999, the entire contents of which are hereby incorporated by reference.

TECHNICAL FIELD

This disclosure relates to swim fins used for swimming underwater or at the surface.

BACKGROUND OF THE INVENTION

This invention relates generally to the field of swimming and diving, and more particularly to a dolphin-tail style multi-purpose swim fin and assembly. The dolphin-tail style swim fin is multi-purpose because it can be used in conjunction with a foot swim fin to increase effectiveness and propulsion and it can also be used by the hands of the swimmer to give additional propulsion, directional control and possible defense against dangers found in open water. When used with the hand, the dolphin-tail style fin can be grasped directly by the swimmer or used with a handle suited for this purpose.

This invention is unique because it combines several ideas to produce unexpected improvements in performance, efficiency, and effectiveness and defense. In the past, most swim fins for the feet have used various shapes of "webbed feet" that provide propulsion by pushing and channeling water more efficiently than our feet can. One notable exception is U.S. Pat. No. 4,934,971 which discloses a swim fin assembly including a novel aerodynamic web shape that reduces turbulence created by the swim fin and improves performance substantially. This disclosure attempts to simulate the swimming action of sea mammals but may be a limitation of those swimming actions because those animals have a complex system of muscles, ligaments and bone that control the angle of attack of the aerodynamic web shape through the water. With natural kicking motions available to the swimmer, the aerodynamic web shape does not move through a stream of water at an angle of attack that takes advantage of its aerodynamic shape.

The present invention arose from continuing efforts to improve the efficiency and operation of the swim fin variations disclosed in U.S. Pat. No. 5,906,525. U.S. Pat. No. 5,906,525 also discloses a swim fin that attempts to simulate the swimming actions of whales and fishes. Again, the lack of control of the angle of attack of the aerodynamic form flowing through the water inhibits any real production of power from the various fins disclosed in that patent.

SUMMARY OF THE INVENTION

According to the details of the dolphin-tail style swim fin embodiment disclosed and shown in the accompanying drawings, the dolphin-tail swim fin is formed as a rigid member having a substantially transverse trailing edge that is generated as a swept-back ellipse with aerodynamically shaped proportional forms as sides that slope towards the center rear portion of the form. This dolphin-tail style swim fin is connected (temporary connection or as an integrated form) to a first swim fin having a first narrow end securable to a user's foot and a second wider end for displacing water to generate propulsion (where the dolphin-tail style swim fin is attached.) The first swim fin a semi-rigid member that allows enough bend when used to present the leading edge of the dolphin-tail style swim fin at a proper angle of attack to the flow of water produced from kicking with the first swim fin. The dolphin-tail swim fin can also be used independent of the first swim fin when used by hand. It can be grasped directly and moved through the water at the correct angle of attack, or it can be held by a handle that would attach by a similar means as the first swim fin.

An object of this invention is to provide efficient power to assist with swimming near the surface of the water or underwater using swim fins designed for the feet that enhance water flow and provide lift.

Another object of this invention is to provide a secondary source of efficient power to a swimmer with the use of swim fins for the hands that work at any speed in the water by providing lift.

Yet another object of this invention is to provide the swimmer with more control using these fins with the hands for steering and lateral locomotion.

A further object of this invention is to provide the swimmer with more control using these fins with the hands for swimming backwards effectively and efficiently even while wearing foot swim fins.

A still further object of this invention is to provide the swimmer with a defensive tool by using these fins with the hands for protection from foreign objects and predators while swimming in open water.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is a swim fin assembly having a swim fin with a narrow end securable to a user's foot (a flat blade fin) and a second wider end for displacing water to generate propulsion and a second swim fin (a dolphin-tail style fin) connected to the second end of the flat blade fin in a path of displaced water from the flat blade fin in which the dolphin-tail style fin is shaped to enhance the propulsion generated by the flat blade fin. This assembly can be composed so that the first and second fin are integral or they can be connected with a connector, a mortise and tenon, or some other means of attachment. The dolphin-tail style fin is shaped to generate lift as water flows across the dolphin-tail style fin. This allows the dolphin-tail style fin to be used without the flat blade fin as a swimming aid for use with the hand. The flow of water over the dolphin-tail style fin is created by the hand moving the dolphin-tail style fin through the water at a proper angle of attack. In addition to creating lift, the dolphin-tail style fin also channels water to the center of the dolphin-tail style fin pulling water away from the sides where it would create vortices and drag. A separate handle can be used when connected to the attachment means found on the dolphin-tail style fin so that the hand can properly move the dolphin-tail style fin through the water to create water flow over the dolphin-tail style fin to generate lift to aid in swimming.

In accordance with one particular aspect of the present invention, a swim fin assembly includes a first swim fin having a first narrow end securable to a user's foot and a second wider end for displacing water to generate propulsion. The assembly also includes a second swim fin connected to the second wider end of the first swim fin in a path of displaced water from the first swim fin, the second swim fin being shaped to enhance the propulsion from the first swim fin. The second swim fin may be integral with the first swim fin or may be attached to the first swim fin with a connector, such as a mortise and tenon connector. The second swim fin is preferably shaped to generate lift as water is flowed across the second swim fin, such as an airfoil-shaped cross-section. The second swim fin is also preferably shaped to channel water toward a center of the second swim fin. Still further, the second swim fin may be curved in a direction of water flow.

In accordance with another aspect of the present invention, a swim fin component attachable to an existing swim fin in a path of displaced water from the existing swim fin is shaped to enhance a propulsion effect from the existing swim fin. The swim fin component may be usable as a swimming aid in a user's hand. In this context, the swim fin component may be attachable to a handle shaped to fit in the user's hand.

In accordance with still another aspect of the present invention, a swim fin assembly includes propulsion structure for generating propulsion and propulsion enhancing structure cooperating with the propulsion structure for enhancing the generated propulsion.

The drawings constitute a part of this specification and include exemplary embodiments to the invention, which may be embodied in various forms. It is to be understood that in some instances various aspects of the invention may be shown exaggerated or enlarged to facilitate an understanding of the invention.

BRIEF DESCRIPTION OF THE DRAWINGS

FIG. 1 is a side perspective view of the invention shown in the act of swimming.

FIG. 2 is a rear perspective view of the invention shown in act of swimming.

FIG. 3 is another side perspective view of the invention shown in the act of swimming.

FIG. 4 is a side perspective view of the dolphin-tail style fin.

DETAILED DESCRIPTION OF PREFERRED EMBODIMENTS

Figures 5, 6, 7:
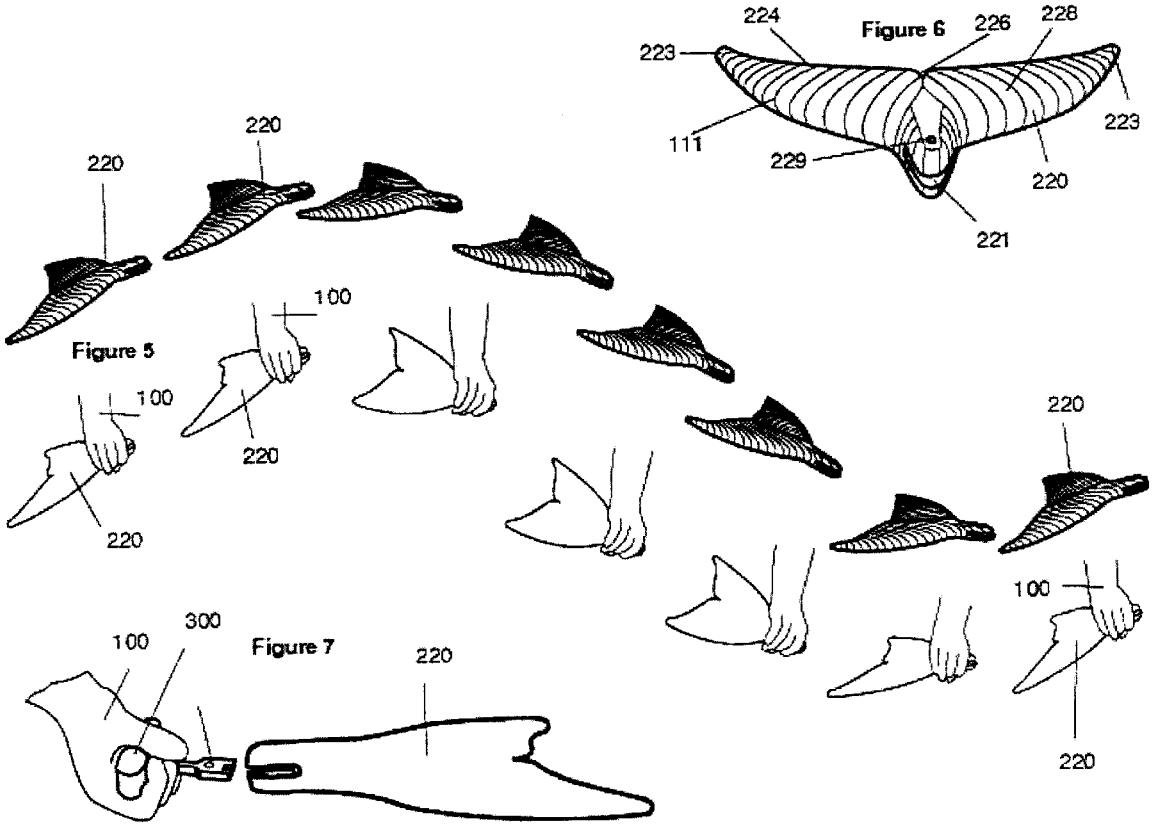
FIG. 5 is composed of a series of side perspective drawings forming two sine curves simulating the movement of the dolphin-tail style fin through the water at the proper angle of attack.
FIG. 6 a frontal perspective view of the dolphin-tail style fin.
FIG. 7 shows a hand holding a handle that could be attached to the dolphin-tail style fin in lieu of a possible flat blade fin.

Detailed descriptions of preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

The most efficient form of swimming can be found by studying the Dolphins and whales who use a "wing-shape" tail fin to effectively produce "lift" by moving their tail fin through the water at a proper angle of attack. The lifting force results from the "airfoil" shape of the tail fin moving through water at an angle of attack that causes the water to flow further around one side than around the other. This increase in distance that the water has to flow causes the water to speed up and create a lift force.

Without proper water flow and angle of attack, the desirable power produced from a lifting form cannot be obtained even with a correct wing shape. Inventions in the past using these wing shapes have not provided a sufficient means of flowing water at a proper angle of attack. This invention provides a sufficient means of water flow and a method to create a proper angle of attack to that flow of water. By using these "wing-shape" fins in conjunction with a standard foot swim fin, or a custom one created for this purpose, the standard foot swim fin (flat blade fin) displaces water that flows over the "wing-shape" fin to help produce lift. These flat blade fins and the connector of the "wing-shape" fin bend from the water pressure produced by a kicking motion in the water and thus provide the "wing-shape" fin with a proper angle of attack to the flow of water. With this proper angle of attack to the flowing water, the "wing-shape" fin provides lift giving additional power that makes swimming easier, more efficient, and more effective.

By gripping these "wing-shape" fins directly with the hand (without the flat blade attached), they can be used as another means for producing "lift" when they are moved through water with the proper angle of attack, be used for steering, and be used for defense. A handle could also be attached and used to assist swimming with the "wing-shape" fins. This handle would possibly use an attachment means that would allow a flat blade fin to attach interchangeably with the handle on the "wing-shape" swim fin.

In the past, swimming under water with swim fins designed for the feet has made the use of the hands impractical, difficult, and inefficient. The problem with using the hands arises from the increased speed produced from using swim fins designed for the feet. At present, hands or hands wearing webbed gloves or hands wearing paddles function only as paddles in the water. The speed at which a person is swimming greatly influences the efficiency and possible use of a paddle. A similar example is seen when trying to use paddles with a boat that has a motor. When the boat is not using the motor, the paddles can be used to push the boat through the water. Paddles can push "still water". If the motor powers the boat more quickly through the water, the paddles cannot be used to push the boat because the water is moving too quickly for them to gain any mechanical leverage and function. If anything, they would probably inhibit the flow of the boat through the water by causing drag (you can image the paddles being "dragged" through the water from the speed produced by the motor.) The same kind of situation arises with the hands in swimming underwater while using swim fins on the feet. The hands cause more "drag" than any benefit that can be gained from their use as a paddle. Thus, when swimming underwater with swim fins on the feet, the hands are almost never used.

Attention is drawn to the fact that a major advantage of using these hand fins arises from the increased ability of the swimmer to change direction easily and have more control while swimming. Because these hand fins aid in propulsion, they can be used to help alter direction without losing speed or increasing effort. By simply aiming them in the desired direction and using them normally, the swimmer is propelled in the new direction without a loss of speed or increase in effort. These dolphin-tail style fins can also be used as rudders for steering. They make swimming a more aquatic experience for the swimmer because he is able to use all of his limbs while swimming and control his direction of swimming with great ease.

When swimming in natural bodies of water, situations occur where turning around is difficult or impossible. These fins can be held in front of the swimmer and can be used to propel the swimmer backwards away from possible danger or undesirable animals without requiring the swimmer to turn around. Another advantage of swimming with the dolphin-tail style swim fin in the hand is that it can be wielded similar to a battle axe with its honed trailing edge and strong points at either end. These fins also offer protection for the hands against foreign objects encountered while swimming.

These dolphin-tail style swim fins, when placed horizontally in the water and released, "sail" across a body of water much as a glider sails through the air. This gliding motion is caused by "lift". A great advantage of using lift is that lift increases with the speed of the flowing water. Even though the forces of lift are increased with an increase in the speed of water flowing over the surface, the effort needed to create a proper angle of attack and movement through water is the same or decreases. This makes this invention exceptionally useful for swimming with swim fins for the feet because they increase the speed that the swimmer moves through the water. An example of this principle is seen everyday on airplanes. The motor and propeller can move a structure through the air, but the lifting forms designed as wings increase the efficiency, speed, and control of the flying structure much as these hand fins help swimmers.

Another new factor in this invention is the curving of the wing shape so that water passing over the shape is channeled towards the center of the form creating a more focused thrust vector and pulling water from the sides of the form. This reduces drag that would normally be created from the vortices created at the edges of the form as it is moved through the water because the water at the edges is pulled towards the center. By pulling this water from the edges of the form, the form creates no vortices with the water that would otherwise be disturbed by the movement of the form. This curved lifting form has more lifting surfaces in a more compact form which also makes it more efficient for swimming.

It is evident that the flat blade fin and the dolphin-tail style swim fin could be made from many possible rubber-like materials such as polyurethane or plastic. Any material that allowed proper flexibility, durability, and reflex ability could be used.

The "wing-shape" fin could possibly be attached to the flat blade fin with a mortise and tenon system, be attached with by means of a connector, or would be part of the flat blade fin in a one-piece construction. Unlike a webbed foot design that has alternating "push" and "recover" strokes, the movement of the dolphin-tail style swim fin through the water consistently produces lift with every movement.

Turning now to the drawings, it is to be noted that FIG. 1 is a side perspective view of the invention shown in the act of swimming. As the foot (600) kicks through the water wearing a flat blade fin (500) with an attached dolphin-tail style fin (220), the flat blade fin (500) bends from the water pressure so that the dolphin-tail style fin (220) travels through the water at a proper angle of attack to create a lifting force and aid in swimming. The flat blade fin (500) provides the propulsion necessary to generate a flow of water over the dolphin-tail style fin (220) so that a lifting force is produced. The foot well (550) and the foot attachment (520) work together to connect the foot to the flat blade fin (500). The attachment means (229) holds the dolphin-tail style fin (220) and the flat blade fin (500) together. The large arrow points in the direction of swimming while the small curved arrow above it points in the upward direction that the foot (600) is kicking. The flow of water (111) is indicated by the small arrow above the lines symbolizing the flow of water (111.)

Upon inspection of FIG. 2, it will be seen that it is a rear perspective view of the invention shown in the act of swimming. The large arrow again indicates the direction of swimming. The dolphin-tail style fin (220) also helps to pull the flow of water into a more focused stream which increases efficiency, effectiveness, and reduces drag because it reduces the vortices that would normally be produced at the edges of the form as it is moved through the water. It does this by pulling water away from sides of the form so that the lateral forces move away from the surrounding water and the production of vortices.

FIG. 3 is another side perspective view of the invention shown in the act of swimming. In this case the largest arrow again points in the direction of swimming. The arrow next to the dolphin-tail style fin (220) shows the direction of the lift forces created by this fin. The small curved arrow below the flat blade fin (500) shows the downward kicking motion of the foot (600) and this fin. Even though the motion of the foot (600) is in the opposite direction of the foot in FIG. 1, the forces of lift are created in both motions.

The flat blade fin (500) and the dolphin-tail style fin (220) can be of a single piece construction or made of two separate pieces that are attached using a mortise and tenon system or some other means of attachment.

FIG. 4 is a side perspective view of the dolphin-tail style fin (220). The curving leading edge (222) and curving airfoil surface (228) help to cause lift and pull the water towards the focusing raceway (226) of the form. This helps to create a vector of the water stream (111) from the center of the trailing edge (224). The trailing points can be created of rigid or semi-rigid material and help the swimmer with fending off rough objects or predatory fish and other animals in open waters when used with the hand. The slot (221) in the connector (225) provides the space necessary in which to slip the flat blade fin (500). The attachment means (229) would then secure the dolphin-tail style fin (220) to the flat blade fin (500). If a mortise and tenon method of attachment were to be used, the slot (221) and the rib (227) would be the mortise and tenon respectively.

FIG. 5 is composed of a series of side perspective drawings forming two sine curves, one above the other, simulating the movement of the dolphin-tail style fin (220) through the water at the proper angle of attack. The lower series of side perspective drawings showing the dolphin-tail style fin (220) held by a hand (100) in a similar sine wave pattern where it is evident that the hand could grip the dolphin-tail style swim fin in this manner while swimming. One could call this figure a "flow" chart because it demonstrates the different angles of attack that the hand would cause the dolphin-tail style fin (220) to assume in order to propel the body through the water. This could be achieved without the need of kicking type propulsion, but is even more effective when used in conjunction with propulsion from the fins on the feet. This usefulness in fast moving water makes this invention a great improvement over any type of plain hand or paddle motion for swimming.

In a like manner to FIG. 4, FIG. 6 is a perspective view of the dolphin-tail style fin (220) viewed now from the front. The curved airfoil type surfaces of the dolphin-tail style fin (220) can be seen by the water flow lines (111). Notice how the water flow lines (111) convert toward the focus raceway (226). As also seen in FIG. 6, the dolphin-tail style fin (220) is curved in the direction of water flow.

FIG. 7 shows a hand (100) holding a handle (300) that could be attached to the dolphin-tail style fin (220) in lieu of a possible flat blade fin (500). The hand (100) would use the dolphin-tail style fin (220) with the handle in this composition instead of holding the dolphin-tail style fin (220) directly as seen in FIG. 5.

While the invention has been described in connection with preferred embodiments thereof, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A swim fin apparatus for securement to a user's foot, which comprises:

a) a flat blade swim fin having a first narrow end releasably secured to said user's foot, said flat blade swim fin with a second wider distal end which extends symmetrically from the first narrow end of the flat blade swim fin for displacing water to generate propulsion; and b) a dolphin tail swim fin having a centrally extended portion integrally connected at a central position of said second wider distal end of the flat blade swim fin, said dolphin tail swim fin flexibly angled in a path of displaced water extending from the second wider end of the flat blade swim fin, the dolphin tail swim fin shaped to enhance the propulsion generated by the displaced water from the second wider end of the flat blade swim fin.

2. The swim fin apparatus of claim 1, wherein a connector means is used to releasably secure the extended central portion of the dolphin tail swim fin at the central portion of the distal end of the flat blade swim fin, for ease of transport and storage.

3. The swim fin apparatus of claim 2, wherein the connector means is a mortise and tendon connector.

4. The swim fin apparatus of claim 1, wherein an outer surface of the dolphin tail swim fin is aerodynamically shaped to generate lift as water flows from the second wider end of the flat blade swim fin across the outer surface of the dolphin tail swim fin.

5. The swim fin apparatus of claim 1, wherein the dolphin tail swim fin comprises a symmetrical, airfoil-shaped cross section which is centrally connected at the central extended portion to a central portion of the distal end of the flat blade swim fin.

6. The swim fin apparatus of claim 1, wherein the dolphin tail swim fin is shaped to channel water from an outer perimeter across the outer surface toward a center portion of the dolphin tail swim fin.

7. The swim fin apparatus of claim 1, wherein the outer surface of the dolphin tail swim fin is curved to direct water flow towards the central portion of the dolphin tail swim fin.

8. A dolphin tail swim fin apparatus comprising: a dolphin tail swim fin with an extended central portion attachable to an existing flat blade swim fin at a central portion of a second wider end of the existing flat blade swim fin for displacing water to generate propulsion, said dolphin tail swim fin apparatus shaped and inclined in relation to the second wider end of the flat blade swim fin to enhance propulsion of water passing across the second wider end of the flat blade swim fin; and the dolphin tail swim fin includes a fastening means to detach and reattach the extended central portion of the dolphin tail swim fin to the central portion of the flat blade swim fin, and the dolphin tail swim fin, when detached, is usable as a hand held swimming aid means, when the extended central portion of the dolphin tail swim fin apparatus is grasped in a user's hand and moved through the water.

9. The swim fin apparatus of claim 8, wherein the extended central portion of the dolphin tail swim fin is integrally connected at the central portion of said second wider end of the flat blade swim fin.

10. The swim fin apparatus of claim 8, wherein a fastening means removably and reattachably secures the extended central portion of the dolphin tail swim fin to the central portion of the second wider end of the flat blade swim fin, for ease of transport and storage.

11. The swim fin apparatus of claim 8, wherein outer surface of the dolphin tail swim fin is shaped to generate lift as water flows across the aerodynamic shape of the dolphin tail swim fin.

12. The dolphin tail swim fin apparatus of claim 8, comprising an airfoil shaped cross-section having symmetrical left and right sides, wherein the outer surface of the dolphin tail swim fin is aerodynamically shaped to generate lift as water flows across the dolphin tail swim fin.

13. The dolphin tail swim fin apparatus of claim 8, wherein the outer surface of the dolphin tail swim fin is shaped to channel water toward a center portion of the dolphin tail swim fin.

14. The dolphin tail swim fin apparatus of claim 8, wherein the outer surface of the dolphin tail swim fin is curved towards the central portion of the dolphin tail swim fin to form an aerodynamic shape to direct water flow towards the central portion of the dolphin tail swim fin.

15. The dolphin tail swim fin apparatus of claim 8, wherein the extended central portion of the dolphin tail swim fin is attachable to a handle shaped to fit a user's hand.

16. A swim fin apparatus comprising:

A flat blade swim fin propulsion means having a first narrow end securable to a user's foot, and a second wider distal end for generating initial propulsion; and a dolphin tail swim fin with an extended central portion which is selectively detached and reattached to the flat blade swim fin by a fastening means, said fastening means releasably secured at a central portion of the second wider distal end of the flat blade swim fin for enhancing the generated initial propulsion, the dolphin tail swim fin with an outer surface which is symmetrically and aerodynamically shaped and angled towards a central portion to enhance propulsion of the displaced water from the distal end of the flat blade swim fin.

* * * * *